US010180657B2

(12) United States Patent
Arata

(10) Patent No.: US 10,180,657 B2
(45) Date of Patent: Jan. 15, 2019

(54) IMAGE FORMING APPARATUS

(71) Applicant: KYOCERA Document Solutions Inc., Osaka (JP)

(72) Inventor: Tatsuro Arata, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/491,356

(22) Filed: Apr. 19, 2017

(65) Prior Publication Data

US 2017/0315505 A1 Nov. 2, 2017

(30) Foreign Application Priority Data

Apr. 27, 2016 (JP) ..... 2016-089772

(51) Int. Cl.

| | |
|---|---|
| ***B65H 29/24*** | (2006.01) |
| ***G03G 15/00*** | (2006.01) |
| ***G03G 15/23*** | (2006.01) |
| ***G03G 21/20*** | (2006.01) |

(52) U.S. Cl.

CPC ..... *G03G 21/206* (2013.01); *B65H 29/247* (2013.01); *G03G 15/6552* (2013.01); *G03G 15/6573* (2013.01); *G03G 15/234* (2013.01)

(58) Field of Classification Search

CPC ..... G03G 21/206; G03G 15/6573; G03G 15/6552; G03G 15/234; B65H 29/247

See application file for complete search history.

(56) References Cited

U.S. PATENT DOCUMENTS

| | | | | |
|---|---|---|---|---|
| 8,139,995 | B1 * | 3/2012 | Fujita | G03G 21/206 399/390 |
| 9,551,968 | B1 * | 1/2017 | Hasebe | G03G 15/5029 |
| 2005/0220520 | A1 * | 10/2005 | Kawamoto | G03G 15/6576 399/405 |
| 2007/0059024 | A1 * | 3/2007 | Kitayama | B65H 29/58 399/92 |
| 2008/0038008 | A1 * | 2/2008 | Fujita | G03G 21/206 399/92 |
| 2008/0044213 | A1 * | 2/2008 | Kato | G03G 15/6573 399/405 |
| 2011/0008087 | A1 * | 1/2011 | Inoue | B65H 85/00 399/341 |

(Continued)

FOREIGN PATENT DOCUMENTS

| | | |
|---|---|---|
| JP | 2002-082591 A | 3/2002 |
| JP | 2008-268643 A | 11/2008 |
| JP | 2016-051098 A | 4/2016 |

OTHER PUBLICATIONS

Notice of Reasons for Refusal mailed by Japan Patent Office dated Oct. 23, 2018 in the corresponding Japanese patent application No. 2016-089772.

*Primary Examiner* — David H Banh

(74) *Attorney, Agent, or Firm* — IP Business Solutions, LLC

(57) ABSTRACT

A sheet discharge port is provided with a guide piece extending obliquely downward in a discharge direction from an upper edge of the sheet discharge port to oppose an outlet port. The guide piece blocks flow of cooling air, which has been blown out from the outlet port, into the sheet discharge port and also abuts the sheet discharged from the sheet discharge port to guide the sheet obliquely downward in the discharge direction.

8 Claims, 6 Drawing Sheets

(56) References Cited

U.S. PATENT DOCUMENTS

| | | | | |
|---|---|---|---|---|
| 2014/0029999 | A1* | 1/2014 | Masuta | G03G 15/6552 399/405 |
| 2014/0169850 | A1* | 6/2014 | Matsuo | G03G 15/2021 399/341 |
| 2017/0082958 | A1* | 3/2017 | Hasebe | G03G 15/5029 |
| 2017/0300009 | A1* | 10/2017 | Yamanaka | G03G 21/206 |

* cited by examiner

IMAGE FORMING APPARATUS

INCORPORATION BY REFERENCE

This application claims priority to Japanese Patent Application No. 2016-089772 filed on 27 Apr. 2016, the entire contents of which are incorporated by reference herein.

BACKGROUND

This disclosure relates to an image forming apparatus.

In some image forming apparatuses, a toner image is fixed onto recording paper through thermocompression, and the recording paper subjected to fixing processing is discharged onto a discharge tray. Continuous discharge of recording paper results in superposition of pieces of recording paper on the discharge tray, which may cause adhesion of the toner image formed on the recording paper to the other piece of recording paper. To prevent the aforementioned adhesion, various ways of blowing cooling air from a cooling fan against the recording paper subjected to the fixing processing have been suggested and put into practice.

SUMMARY

A technology obtained by further improving the technology described above will be suggested as one aspect of the present invention.

An image forming apparatus according to one aspect of this disclosure includes: an image formation section, a sheet discharge port, a discharge path, a cooling section, and a guide piece.

The image formation section forms an image on a sheet.

The sheet discharge port discharges the sheet to a discharge tray.

The discharge path communicates with the sheet discharge port.

The cooling section includes a cooling fan, and a cooling duct having one end part coupled to the cooling fan and another end part having at least one outlet port discharging cooling air generated by the cooling air fan.

The at least one outlet port opens downward at a position located above the sheet discharge port and on a downstream side in a discharge direction of the sheet.

The sheet discharge port is provided with a guide piece extending obliquely downward in the discharge direction from an upper edge of the sheet discharge port to oppose the outlet port.

The guide piece blocks flow of the cooling air, which has been blown out from the outlet port, into the sheet discharge port and also abuts the sheet discharged from the sheet discharge port to guide the sheet obliquely downward in the discharge direction.

DETAILED DESCRIPTION

Figure 1:
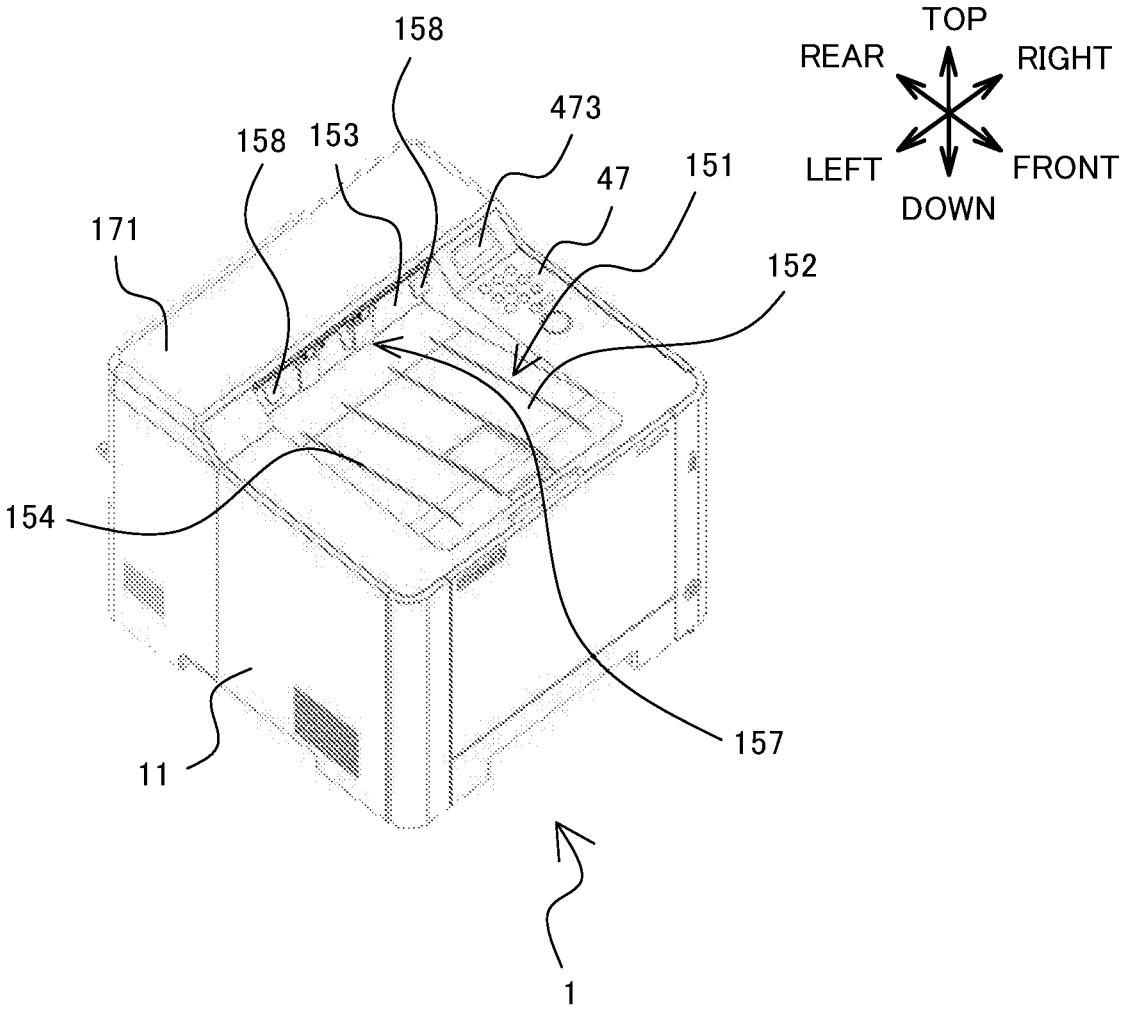
FIG. 1 is a perspective view illustrating outer appearance of an image forming apparatus according to a first embodiment of this disclosure.

Hereinafter, an image forming apparatus according to one embodiment of this disclosure will be described with reference to the drawings. FIG. 1 is a perspective view illustrating outer appearance of the image forming apparatus according to the first embodiment of this disclosure. The image forming apparatus 1 is a printer, and includes: an apparatus body 11 which stores, for example, an image formation section 12 to be described later on, and also an operation section 47 and a display section 473 provided at a top of the apparatus body 11; a recording paper discharge port 157 (an example of the sheet discharge port defined in the scope of the claims); a discharge tray 151; recording paper pressing members 158 (examples of the sheet pressing member defined in the scope of the claims); and a top cover 171.

The operation section 47 receives, from an operator for various kinds of operation and processing executable by the image forming apparatus 1, instructions such as an image formation operation execution instruction. The display section 473 displays information illustrating a status of the image forming apparatus 1.

The recording paper discharge port 157 is located on a downstream side of a fixing section 13 to be described later on and discharges recording paper (an example of the sheet defined in the scope of the claims). Formed on a downstream side of the recording paper discharge port 157 in a discharge direction of the recording paper are a plurality of recording paper pressing members 158 arrayed separately from each other at an interval therebetween in a width direction horizontally orthogonal to the discharge direction of the recording paper, and, for example, curl correction of the discharged recording paper is performed at the recording paper pressing members 158. Specifically, each of the plurality of recording paper pressing members 158 is provided at a position located on a downstream side of a guide piece to be described later on in the discharge direction of the recording paper, and abuts the recording paper discharged from the recording paper discharge port 157 to press the recording paper. As a result, for example, the curl correction of the discharged recording paper can be performed, which permits appropriate discharge of the recording paper.

The recording paper discharged from the recording paper discharge port 157 is loaded on the discharge tray 151. The discharge tray 151 includes: a loading surface 152 which is inclined downward from a front portion to a rear portion; and a vertical wall 153 which extends vertically upward from a rear end part of the loading surface 152 to an area near a lower edge part of the recording paper discharge port 157. The loading surface 152 is provided with a plurality of ribs 154 which extend in the discharge direction and which are arrayed separately from each other at an interval therebetween in the width direction orthogonal to the discharge direction.

Figure 2:
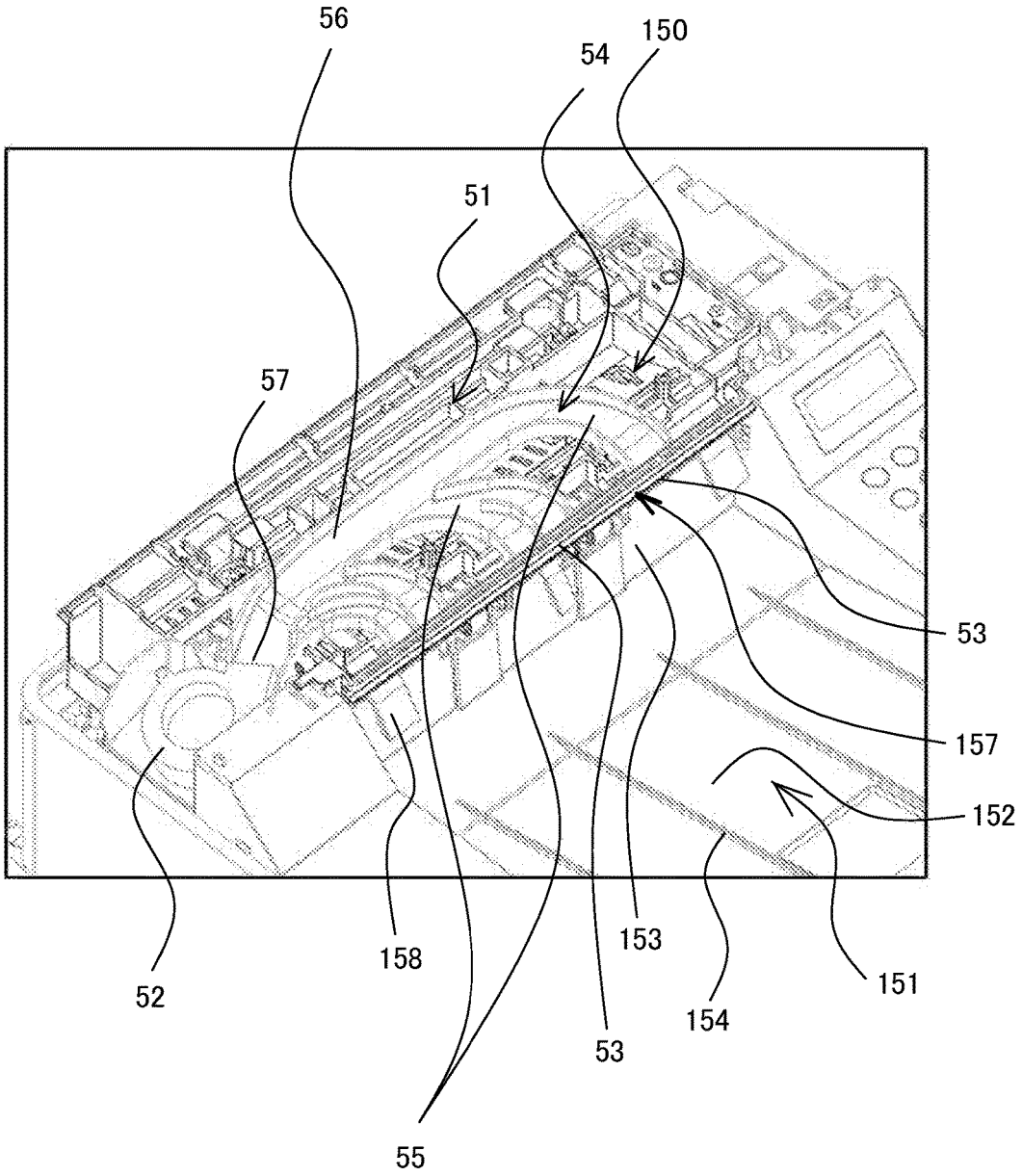
FIG. 2 is an enlarged perspective view illustrating a cooling section and a surrounding part thereof.

FIG. 2 is an enlarged perspective view illustrating a surrounding part of the top cover 171 with the top cover 171 removed. The apparatus body 11 is provided with a storage section 150 storing a cooling section 51 which blows cooling air against the recording paper discharged from the recording paper discharge port 157. The cooling section 51 is covered by the top cover 171 (FIG. 1).

The cooling section 51 includes: a cooling fan 52; a plurality of cooling air discharge ports 53 which discharge cooling air from the cooling fan 52; and a duct 54 which induces the cooling air from the cooling fan 52 to the cooling air discharge ports 53. Note that each of the cooling air discharge ports 53 is part of the duct 54 and coupled to an opening (not illustrated) formed at a lower surface of the storage section 150 to communicate with an outside of the apparatus body. The duct 54 is one example of a cooling duct in the scope of the claims.

The duct 54 includes: an intake port 57 which is coupled to the cooling fan 52 to take in the air; a plurality of branching paths 55; and a coupling section 56 which couples together the intake port 57 and the branching paths 55. The duct 54 has the cooling air discharge ports (outlet ports) 53 respectively formed at diverging destinations and guides, to the cooling air discharge ports 53, the cooling air generated by the cooling fan 52. The cooling air discharge ports 53 are arranged at position located above the recording paper discharge port 157 and on a downstream side in the discharge direction of the recording paper in a manner such as to direct a cooling air discharge direction downward, and coupled to an opening (not illustrated) formed at position corresponding to the cooling air discharge ports 53 at a lower surface of the storage section 150.

Figure 3:
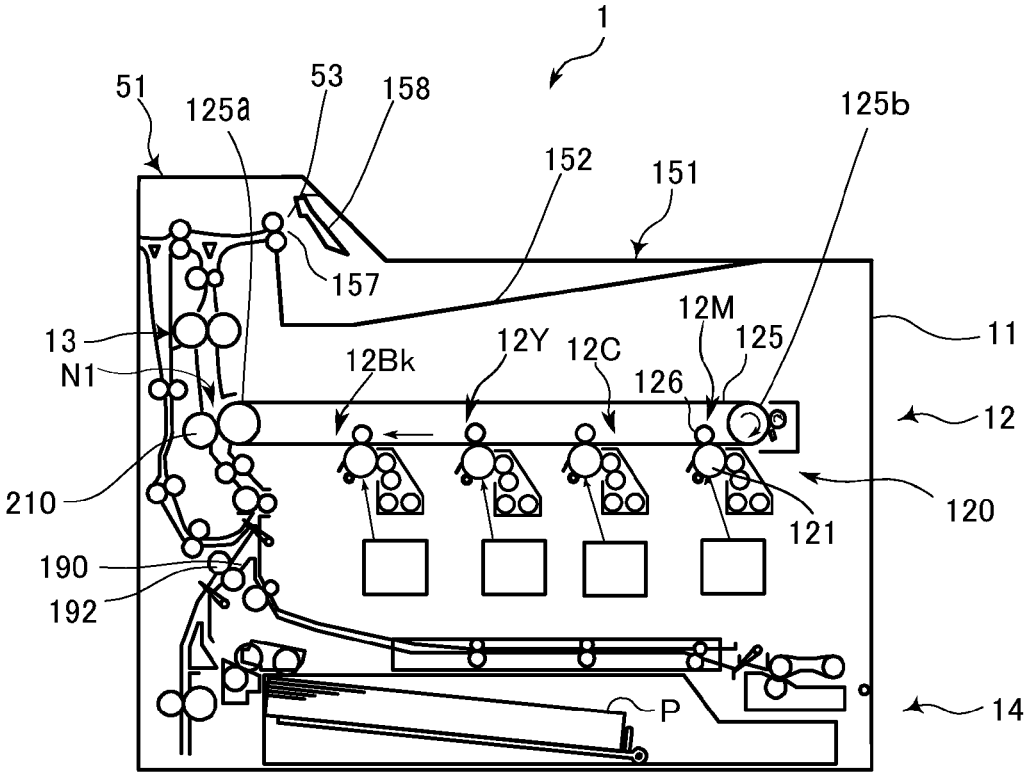
FIG. 3 is a sectional side view of the image forming apparatus.

FIG. 3 is a sectional side view of the image forming apparatus 1. The image forming apparatus 1 includes, in the apparatus body 11, the operation section 47 (FIG. 1), the display section 473 (FIG. 1), the image formation section 12, the fixing section 13, a paper feed section 14, and the cooling section 51.

A case where image formation operation is performed in the image forming apparatus 1 will be described. Based on, for example, image data received from a computer connected to the network, the image formation section 12 forms a toner image on a recoding paper P fed from the paper feed section 14.

The image formation section 12 includes an image formation unit 12Bk for black (Bk), an image formation unit 12Y for yellow (Y), an image formation unit 12C for cyan (C), and an image formation unit 12M for magenta (M). The image formation units 12Bk, 12Y, 12C, and 12M respectively include photoconductors 121 of a drum type, which are configured in a manner such as to be driven to rotate counterclockwise in the figure.

A transfer section 120 includes: an intermediate transfer belt 125 onto an outer circumferential surface of which a toner image is transferred; a driving roller 125*a*, a driven roller 125*b*, and a primary transfer roller 126.

The intermediate transfer belt 125 is stretched between the driving roller 125*a* and the driven roller 125*b*, is driven by the driving roller 125*a* while abutting circumferential surfaces of the photoconductors 121, and endlessly runs synchronously with the photoconductors 121.

A case where color printing is performed will be described. Surroundings of the photoconductors 121 are evenly charged (a charging process), laser light is irradiated to surfaces of the electrically charged photoconductors 121 based on image data to form latent images (an exposure process), and the latent images are visualized by a toner (a developing process). Then the toner images formed through the visualization are transferred onto the intermediate transfer belt 125 by the primary transfer roller 126.

The toner images of the respective colors (black, yellow, cyan, and magenta) to be transferred onto the intermediate transfer belt 125 are superposed on each other on the intermediate transfer belt 125 through transfer timing adjustment, turning into a color toner image.

A secondary transfer roller 210 transfers, at a nip part N1 formed with the driving roller 125*a* with the intermediate transfer belt 125 in between, the color toner image, which has been formed on the surface of the intermediate transfer belt 125, onto the recoding paper P conveyed from the paper feed section 14 through a conveyance path 190. The above description refers to the case of color printing, and in case of monochromatic printing, the photoconductors for yellow, cyan, and magenta are not used and only the photoconductor 121 for black is used.

The fixing section 13 fixes the toner image on the recoding paper P through thermal compression, and includes: a heating roller which melts the toner on the recoding paper P; and a pressure roller which firmly attaches the recoding paper P to the heating roller.

The recoding paper P on which the color image has already been formed and subjected to the fixing processing is delivered by a driving roller 192 to a downstream side in a discharge direction of the recoding paper P, and is discharged onto the discharge tray 151 from the recording paper discharge port 157. The cooling air discharged from the cooling air discharge ports 53 is blown against the recoding paper P discharged from the recording paper discharge port 157. Note that a conveyance path which connects the fixing section 13 and the recording paper discharge port 157 with each other and which is provided for discharging the recoding paper P subjected to the fixing processing from the recording paper discharge port 157 is one example of the discharge path in the scope of the claims. Moreover, the duct 54 is arranged above the aforementioned conveyance path.

Figure 4:
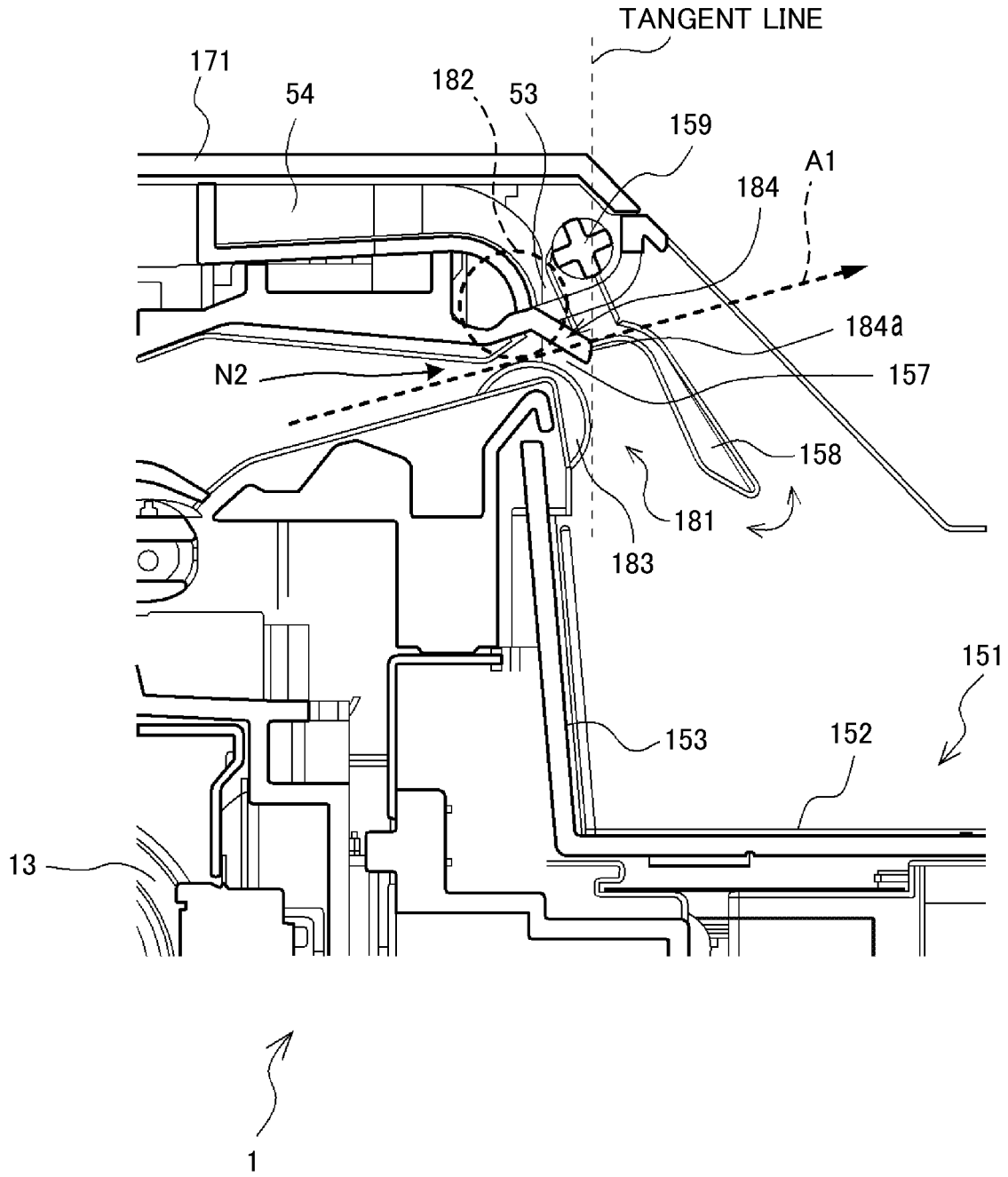
FIG. 4 is a sectional side view illustrating a sheet discharge port and a surrounding part thereof.

The paper feed section 14 is provided with a paper feed cassette, and includes a pickup roller for picking up recoding paper P stored in the paper feed cassette. The recoding paper P picked up by the pickup roller is conveyed towards the recording paper discharge port 157 by a pair of discharge rollers 181 (FIG. 4). The discharge rollers 182 and 183 are one example of an upper discharge roller and one example of a lower discharge roller, respectively, in the scope of the claims.

FIG. 4 is a sectional side view illustrating the recording paper discharge port 157 and a surrounding part thereof.

The recording paper discharge port 157 is provided with the pair of discharge rollers 181 which discharge recoding paper P.

The recoding paper P subjected to the fixing processing performed by the fixing section 13 is delivered to the downstream side in the discharge direction by the driving roller 192, passes through a nip part N2 formed between the pair of discharge rollers 181, and is discharged onto the discharge tray 151 from the recording paper discharge port 157. The pair of discharge rollers 181 includes a tangent line passing through the nip part N2 and extending obliquely upward towards the downstream side in the discharge direction and thereby discharges a tip of the conveyed recoding paper P obliquely upward. Symbol A1 in the figure denotes the discharge direction of the recoding paper P.

The cooling air discharge ports 53 are arranged on a downstream side of the recording paper discharge port 157 in the discharge direction and above the recording paper discharge port 157 in a manner such as to face downward. At an upper edge of the recording paper discharge port 157, a guide piece 184 is elongated which prevents the cooling air discharged from the cooling air discharge port 53 from flowing into the fixing section 13 from the recording paper discharge port 157.

The guide piece 184 is provided at a position which is located below the cooling air discharge ports 53 and which extends from a top to a bottom of the recording paper discharge port 157. The guide piece 184 extends in a width direction of the recording paper horizontally orthogonal to the discharge direction of the recoding paper P. The guide piece 184 is postured in a manner such as to block travel of the air discharged from the cooling air discharge port 53 around the recording paper discharge port 157 (that is, the guide piece 184 blocks flow of the cooling air, which has been blown out from the cooling air discharge ports 53, into the recording paper discharge port 157). The guide piece 184 abuts the recoding paper P discharged from the recording paper discharge port 157 to perform correction which directs the discharge direction of the recoding paper P obliquely downward.

The guide piece 184 conditioned to cover a part of the recording paper discharge port 157 from an upper edge thereof (from above) in viewed from an outside of the recording paper discharge port 157 in the discharge direction. The guide piece 184 comes in contact with the tip of the recoding paper P discharged from the recording paper discharge port 157 to guide the tip obliquely downward.

The guide piece 184 is angled in a manner such as to extend in a direction towards the loading surface 152 (downward in FIG. 4). For example, the guide piece 184 is provided in a manner such as to form a sharp angle relative to the discharge direction A1 of the recoding paper P. The guide piece 184 has a tip part 184*a* located below and on a downstream side of the nip part N2 formed between the pair of discharge rollers 181 in the discharge direction.

The discharge roller 183 has a circumferential surface provided in a manner such as to project upward in the recording paper discharge port 157. Specifically, the discharge roller 183 is provided at an inner bottom part of the recording paper discharge port 157 as illustrated in FIG. 4. The pair of discharge rollers 181 guides the conveyed recoding paper P in a manner such as to direct the tip of the recoding paper P upward. The guide piece 184 is located on a tangent line on the downstream side in the discharge direction, the tangent line extending vertically to an outer circumferential surface of the discharge roller 183.

The recoding paper P discharged from the recording paper discharge port 157 after corrected by the guide piece 184 is subjected to, for example, curl correction performed by the recording paper pressing members 158. The cooling air discharge ports 53 are arranged above the guide piece 184 and on an upstream side of the recording paper pressing members 158 in the discharge direction in viewed in an axial direction (width direction) of the pair of discharge rollers 181. The recording paper pressing members 158 are supported at the apparatus body 11 in the storage section 150 by a support member 159, which is arranged above the cooling air discharge ports 53 and on a downstream side thereof in the discharge direction, in a manner such as to be rotatable in an arrow direction illustrated in FIG. 4.

Typically, blowing cooling air directly against recording paper discharged onto a discharge tray is effective in cooling of the recording paper subjected to fixing processing. Moreover, possible configuration for achieving the aforementioned effect is such that a cooling air discharge port for discharging cooling air is arranged above a recording paper discharge port from which recording paper is discharged.

However, in a case where the cooling air discharge port is arranged above the recording paper discharge port to cool the discharged recording paper, since the recording paper discharge port is provided above the fixing section in many cases, the cooling air discharged from the cooling air discharge port travels around the fixing section from the recording paper discharge port, which raises a problem of deteriorated cooling efficiency.

On the contrary, in the first embodiment described above, the cooling air discharge ports 53 are arranged above the recording paper discharge port 157 and on the downstream side thereof in the discharge direction in a manner such as to face downward, which permits the cooling air to be directly blown against the recoding paper P subjected to the fixing processing. Then the guide piece 184 lies between the cooling air discharge ports 53 and the recording paper discharge port 157 to block the recording paper discharge port 157 from the cooling air discharge ports 53.

Thus, entrance of the cooling air, which has been discharged from the cooling air discharge ports 53, into the image forming apparatus 1 from the recording paper discharge port 157 followed by the travel of the cooling air around the fixing section 13 is prevented. As a result, occurrence of a situation such that the fixing section 13 is cooled by the cooling air discharged from the cooling air discharge ports 53 can be reduced, which makes it possible to efficiently cool the recoding paper P discharged after subjected to the fixing processing. That is, upon the cooling of the fixing section 13 by the cooling air discharged from the cooling air discharge ports 53, it is required to control a temperature for fixing, performed by the fixing section 13, at a high temperature by a degree which permits compensation of the aforementioned cooling, while such control is not required in the present embodiment.

Figure 5:
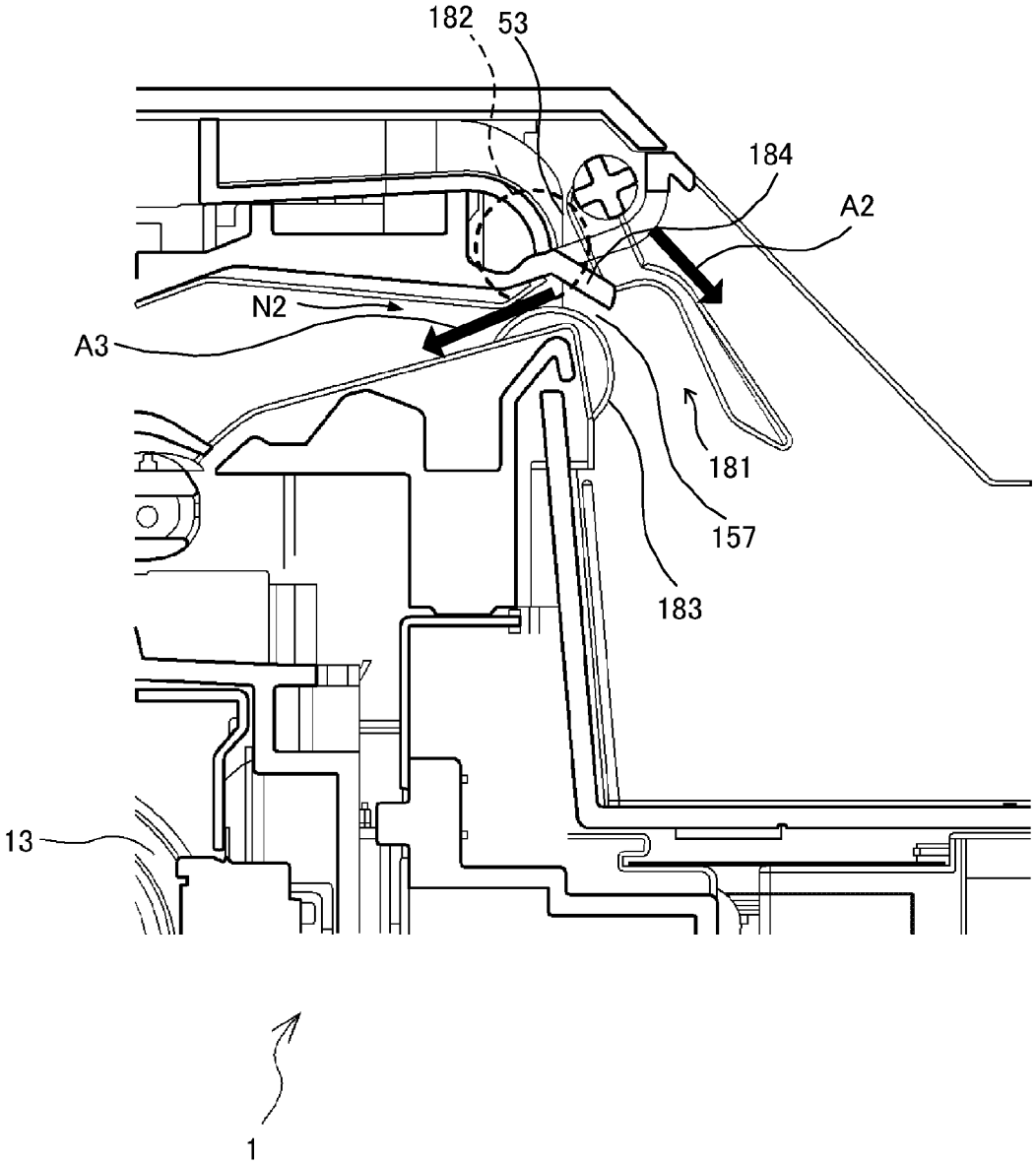
FIG. 5 is a view illustrating a flow direction of cooling air.

FIG. 5 is a diagram illustrating a flow direction of the cooling air. As illustrated in FIG. 5, the cooling air discharged from the cooling air discharge ports 53 flows in a direction of arrow A2, but as a result of the blockage of the recording paper discharge port 157 by the guide piece 184, the cooling air does not flow in a direction of arrow A3 extending from the recording paper discharge port 157 towards the fixing section 13.

The guide piece 184 extends in the direction towards the loading surface 152 (downward in FIG. 4), which therefore permits the discharge direction of the recoding paper P discharged from the recording paper discharge port 157 to be changed to a loading surface 152 side. In addition, a tip of the guide piece 184 reaches the tangent line of the discharge roller 183, which therefore permits reduction in occurrence of entrance of the cooling air, which has been discharged from the cooling air discharge ports 53, from the recording paper discharge port 157 into the apparatus.

A too large length of the guide piece 184 delays start of the cooling of the recoding paper P, while a too small length of the guide piece 184 results in difficulties in preventing the cooling air, which has been discharged from the cooling air discharge ports 53, from traveling around the fixing section 13. The guide piece 184 has the tip part 184*a* which is located on the tangent line on the downstream side in the discharge direction, the tangent line extending vertically to the outer circumferential surface of the discharge roller 183. Also, the tip part 184*a* is dimensioned to have such a length that covers the recording paper discharge port 157 in the vertical direction. As a result, the guide piece 184 prevents the travel of the cooling air around the fixing section 13 while not preventing a flow of the cooling air discharged from the cooling air discharge ports 53 towards the recoding paper P. Thus, the presence of the guide piece 184 does not cause any trouble with the cooling of the recoding paper P by the cooling air.

Figure 6:
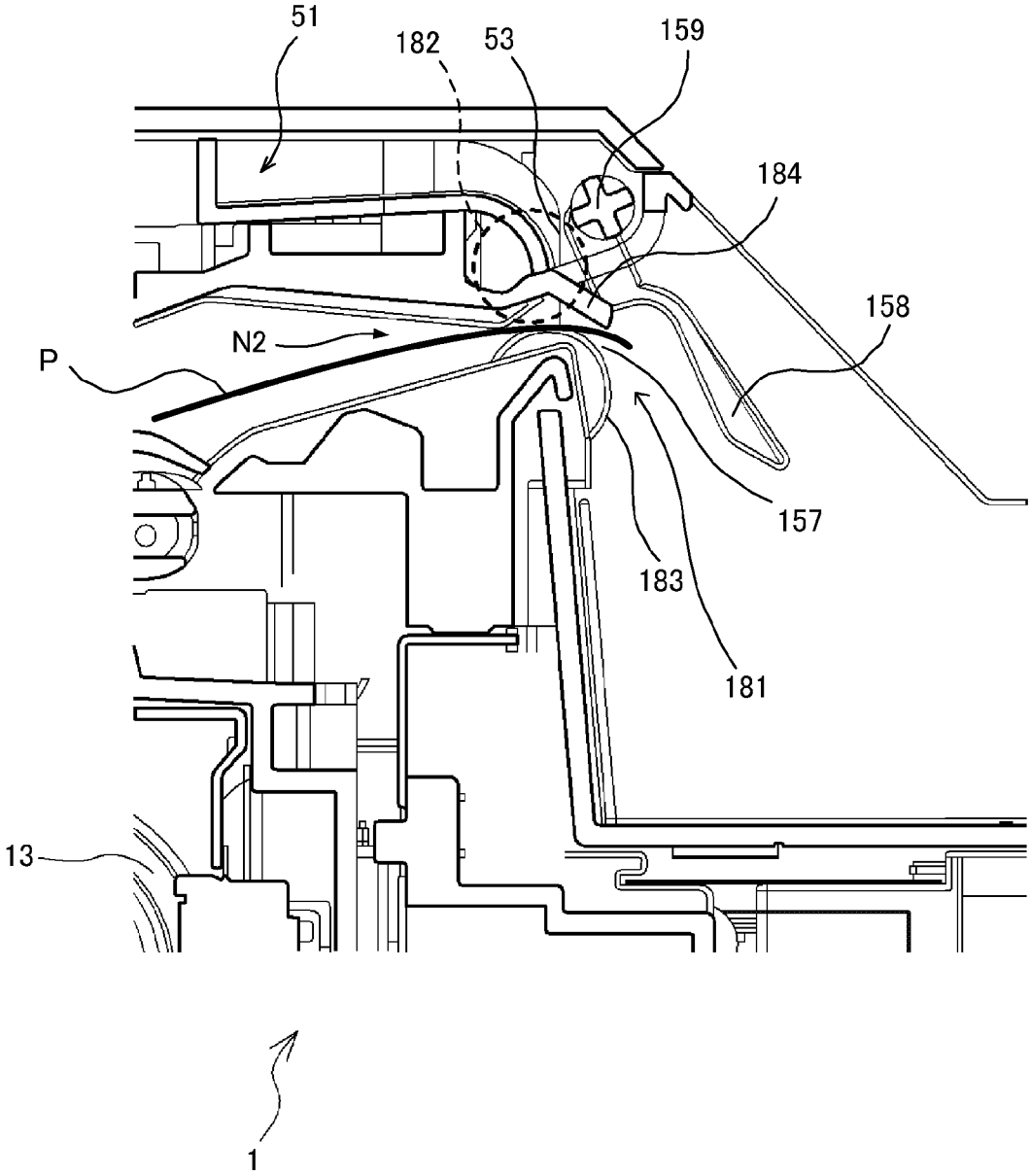
FIG. 6 is a view illustrating another function of a guide piece.

As illustrated in FIG. 6, the guide piece 184 performs correction of directing the tip part of the recoding paper P, discharged from the recording paper discharge port 157, obliquely downward, which therefore makes it possible to no longer require the recording paper pressing members 158. As a result of requiring no recording paper pressing member 158, the support member 159 which supports the recording paper pressing members 158 is also no longer required. Therefore, layout limitations can be reduced, which also makes it possible to move the positions of the cooling air discharge ports 53 to a further front in the discharge direction of the recoding paper P and more effectively blow the cooling air against the recoding paper P.

An image forming apparatus of, for example, an inkjet type which does not include the fixing section 13 may be applied as another embodiment. Specifically, the image forming apparatus may be configured such that while cooling air is blown against recording paper, on which image formation by use of ink has been performed, to thereby effectively perform drying processing on the recording paper and the ink formed thereon, inflow of the cooling air towards an inkjet head is prevented by a guide piece.

The invention is not limited to the embodiments described above and various modifications thereto can be made. In the above embodiment, described as one embodiment of the image forming apparatus according to the invention is a printer, which is only one example, and a different electronic device, for example, another image forming apparatus having a copy function, a printer function, a scanner function, and a facsimile function may be used.

Moreover, in the above embodiment, the configuration and processing illustrated by the above embodiment with reference to FIGS. 1 to 6 are just one embodiment of this disclosure, and thus this disclosure is not limited to the aforementioned configuration and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

an image formation section for forming an image on a sheet;

a sheet discharge port for discharging the sheet to a discharge tray;

a discharge path communicating with the sheet discharge port; and a cooling section including a cooling fan and a cooling duct having one end part coupled to the cooling fan and another end part having at least one outlet port discharging cooling air generated by the cooling fan, wherein the at least one outlet port opens downward at a position located above the sheet discharge port and on a downstream side in a discharge direction of the sheet, the sheet discharge port is provided with a guide piece extending obliquely downward in the discharge direction from an upper edge of the sheet discharge port to oppose the outlet port, and the guide piece includes a downstream surface that faces the downstream side in the discharge direction and an upstream surface that faces an upstream side in the discharge direction, the downstream surface blocking flow of the cooling air, which has been blown out from the outlet port, into the sheet discharge port and the upstream surface abutting the sheet discharged from the sheet discharge port to guide the sheet obliquely downward in the discharge direction.

2. The image forming apparatus according to claim 1, further comprising a fixing section fixing a toner image on the sheet, wherein the discharge path connects the sheet discharge port and the fixing section with each other.

3. The image forming apparatus according to claim 1, wherein the guide piece is arranged so as to cover a part of the sheet discharge port from the above in viewed from an outside of the sheet discharge port in the discharge direction of the sheet.

4. The image forming apparatus according to claim 1, wherein the sheet discharge port is provided with at least one pair of discharge rollers discharging the sheet, the at least one pair of discharge rollers including an upper discharge roller and a lower discharge roller abutting each other to form a nip part therebetween, and the at least one pair of discharge rollers includes a tangent line passing through the nip part and extending obliquely upward towards the downstream side in the discharge direction, the at least one pair of discharge roller discharges, obliquely upward, a tip of the sheet.

5. The image forming apparatus according to claim 4, wherein the at least one pair of discharge roller includes a plurality of discharge roller pairs arranged at an interval therebetween in a width direction of the sheet discharge port intersecting the discharge direction, and the at least one outlet port of the cooling duct includes a plurality of outlet ports, the plurality of outlet ports are respectively arranged between the plurality of discharge roller pairs.

6. The image forming apparatus according to claim 4, wherein in an obliquely upward direction that is a direction in which the pair of discharge rollers discharges the tip of the sheet obliquely upward, a tip part of the guide piece is arranged at a position lower than the nip part and on a tangent line extending vertically and touching an outer circumferential surface of the lower discharge roller on a downstream side in the discharge direction.

7. The image forming apparatus according to claim 1, further comprising a sheet pressing member being provided at a position located on a downstream side of the guide piece in the discharge direction, the sheet pressing member abutting the sheet discharged from the sheet discharge port to press the sheet.

8. The image forming apparatus according to claim 1, wherein the guide piece comes in contact with the tip of the sheet being discharged from the sheet discharge port and guides the tip of the sheet obliquely downward.

* * * * *